US005836655A

United States Patent [19]

Laufer

[11] Patent Number: 5,836,655

[45] Date of Patent: Nov. 17, 1998

[54] STRAP RETAINER ASSEMBLY AND METHOD

[75] Inventor: Steve Laufer, Miami, Fla.

[73] Assignee: Miami Metal Products, Inc., Miami, Fla.

[21] Appl. No.: 786,995

[22] Filed: Jan. 23, 1997

Related U.S. Application Data

[63] Continuation of Ser. No. 410,822, Mar. 27, 1995, abandoned.

[51] Int. Cl.[6] ..... A47C 7/02

[52] U.S. Cl. ..... 297/452.63; 297/452.56; 160/392

[58] Field of Search ..... 277/452.63, 452.64, 277/452.2, 452.56; 160/392, 398, 371; 24/302, 576, 577, 578, 586, 590, 683, 702; 403/28, 291

[56] References Cited

U.S. PATENT DOCUMENTS 1,246,544 11/1917 Chassaing ..... 160/392 X
2,839,126 6/1958 O'Neill ..... 160/392
3,107,944 10/1963 Baermann ..... 297/452.64 X

FOREIGN PATENT DOCUMENTS 3211117 10/1983 Germany ..... 297/452.63
565290 7/1957 Italy ..... 297/452.63

*Primary Examiner*—Laurie K. Cranmer

[57] ABSTRACT

The strap retainer assembly comprises an anchor and insert wherein in the anchor is permanently secured to the frame of the furniture. The anchor has an opening large enough to accept the insert, yet be positioned such that when the insert is pulled laterally, it is retained by the anchor. The insert comprises a strap having opposed ends; each end is looped and secured by a clip. The clip is the portion of the insert placed into the opening of the anchor hereinabove mentioned. On furniture, the frame is fitted with opposing anchors. The insert is heated resulting in a pliable strap. Each clip of the insert is placed in the opposing anchors. When the strap medium cools, it shrinks causing a taught horizontal fit, thus bridging the furniture frame. The number of inserts placed within the anchors on furniture is dependent upon the sizing (width) of the inserts and the overall length of the anchors.

8 Claims, 1 Drawing Sheet

STRAP RETAINER ASSEMBLY AND METHOD

FIELD OF THE INVENTION

This is a continuation of application Ser. No. 08/410,822 filed on Mar. 27, 1995, now abandoned.

This invention relates to the construction and manufacture of furniture. More specifically, the present invention relates to a novel strap retaining assembly for use in bridging sections of framed furniture for support of the user.

BACKGROUND OF THE INVENTION

Furniture manufacturing requires structure to support the user of the furniture. For some types of furniture, this structure embodies a frame having springs or coils thereon. The frame is upholstered with padding to soften the coils. This is typical of the seat section and back section of this type of furniture. Thereafter, cushions may be added to further soften the furniture and to add decorative design.

Another type of furniture that incorporates a fixed frame to support the user is one which uses a metal tube that may be extruded. The frame is fashioned to form the desired skeletal structure, for example, a seating device. The seat portion and/or back portion or side portions of this furniture may be completed with fixed slats that are welded, or secured by other means, into place to support the user of the device. Cushions may be added thereon to soften the slats and add design features.

Another method of bridging the furniture sections above referred to employs the use of a synthetic strapping, such as vinyl, that is drawn taught from side to side, for example, the seat portion of the seating device. This strapping, of course, may be used for the back portion or the side portions of the desired furniture. Typical applications of strapping of this nature require that the strapping be wrapped around the frame and drawn taughtly across the frame where the synthetic material is wrapped about the other side of the frame. The strapping material is then secured, by example, by being screwed into the frame itself. Furniture of this nature is known to exist in the form of "patio" or "pool" furniture which is further known to be less stylish than other types of outdoor or indoor furniture.

In order to cure the problem of style, others have attempted to "hide" the strapping by providing a strap having a hooking means attached to the end thereof, and some hook engaging means on the frame to communicate with the hooking means of the strap. While this method eliminates the need to wrap the strapping around the furniture frame, the hooks employed oftentime break and further, cause too much stress on the sythetic strapping as a relatively small section of the strap end is called upon to bear the full force of weight applied by the user. Additionally, these hooks referred to are set at predetermined distances apart from one another by the manufacturer; there is no opportunity for an end user to adjust the gap between the straps.

SUMMARY OF THE INVENTION

The present invention overcomes the aforementioned problems and undesirable elements of the prior art by providing a strap retainer assembly for furniture. The strap retainer assembly comprises an anchor and insert wherein in the anchor is permanently secured to the frame of the furniture. The anchor has an opening large enough to accept the insert, yet be positioned such that when the insert is pulled laterally, it is retained by the anchor. The insert comprises a strap having opposed ends; each end is looped and secured by a clip. The clip is the portion of the insert placed into the opening of the anchor hereinabove mentioned. On furniture, the frame is fitted with opposing anchors. The insert is heated resulting in a pliable strap. Each clip of the insert is placed in the opposing anchors. When the strap medium cools, it shrinks causing a taught horizontal fit, thus bridging the furniture frame. The number of inserts placed within the anchors on furniture is dependent upon the sizing (width) of the inserts and the overall length of the anchors.

It is thus an object of the present invention to provide a strap retainer assembly for furniture.

It is another object of the present invention to provide furniture utilizing a hookless strap retainer assembly.

It is yet another object of the present invention to provide a strap means for bridging the frame of furniture without exposing the said strap to the frame itself.

It is still another object of the present invention to provide a strap retainer assembly for furniture that need not be wrapped about the frame of the furniture.

It is still yet another object of the present invention to provide a method for bridging the frame of furniture using an anchor and insert strap retainer assembly.

It is still another object of the present invention to permit the end user to vary the gap between respective inserts in the strap retainer assembly employed with furniture as disclosed and taught.

BRIEF DESCRIPTION OF THE DRAWINGS

A better understanding of the invention may be had by reference to the following description, taken in conjunction with the accompanying drawings, in which.

DETAILED DESCRIPTION OF THE PREFERRED EMBODIMENT

Figure 1:
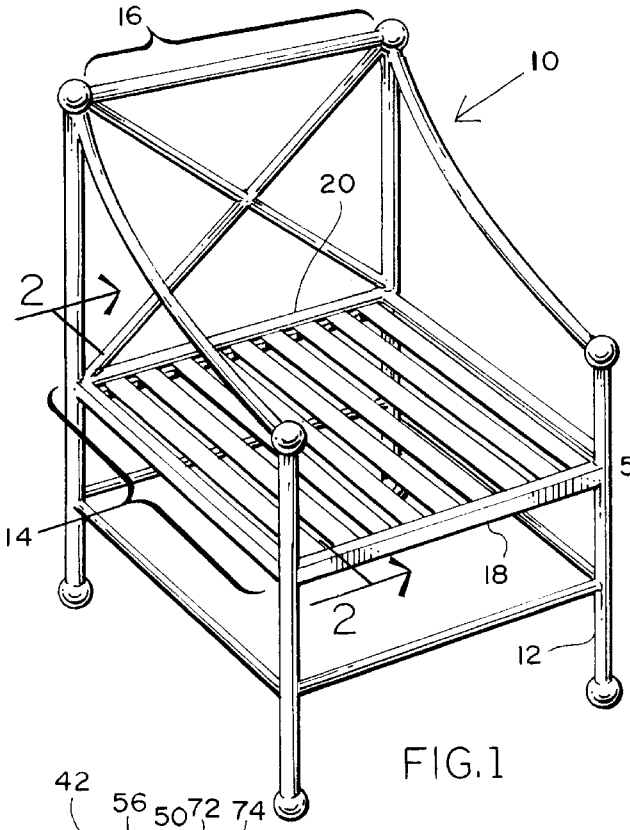
FIG. 1 is a perspective view of the strap retainer assembly as used for furniture.
Figure 2:
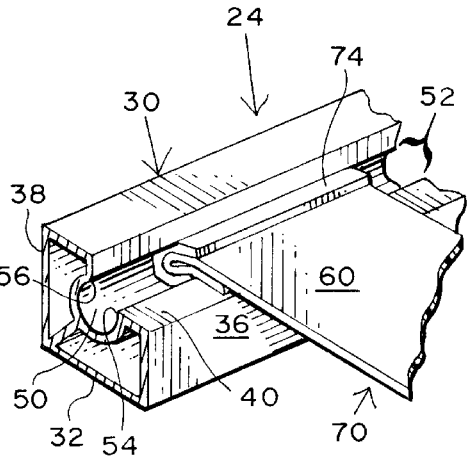
FIG. 2 is a fragmented, perspective view of the anchor and insert of the present invention taken along Line 2—2 of FIG. 1.

Referring to FIG. 1, furniture 10 is constructed of a frame 12. There exists on furniture l a seat frame 14 and a back frame 16. The seat frame 14 is comprised of opposed supports 18 and 20, respectively.

FIGS. 2 through 5, depict a strap retainer assembly 24. The assembly comprises, in part, an anchor 30. Anchor 30 has a base 32, and opposed front 36 and back 38 sections. Front section has a top 40 and back section has a top 42. The back section 38 has a greater length than that of the front section 36. Anchor 30 may be made of a material capable of supporting the weight of a user of furniture, such as aluminum. It may be extruded to a particular shape or may be die cast.

Anchor 30 is substantially rectangular in shape and may be generally described as having an X axis which runs generally horizontally and a Y axis which runs generally vertically. Along the X axis of anchor 30 is cavity 50 which runs through the entire length of anchor 30. The cavity 50 has a shape capable of accepting a matable insert 70 hereinbelow described. It is preferred that the shape of cavity 50 be generally round or annular. Cavity 50 has an opening 52 for accepting the aforementioned insert 70.

The cavity 50 has a center point which meets at the intersection of the X and Y axes of anchor 30. This center point is below the top 40 of the anchor 30. The center point along the Y axis is displaced away from back section 38 and toward front section 36 of anchor 30. A representative position of the center point may be seen in FIG. 3.

The location of opening 52 of cavity 50 is diagonal to that of the X axis and Y axis of anchor 30. Opening 52 needs to be large enough to accept insert 70. However, it has been determined, and is disclosed here, that the opening 52 should be greater than 100 degrees measured from the center point of cavity 50. The preferred embodiment though is that the opening have an expanse of 111 degrees from the edge 54 of top 40 to edge 56 of top 42. It is further preferred that edges 54 and 56 comprise right angles and be "sharp" rather than being smooth or rounded.

Figure 3:
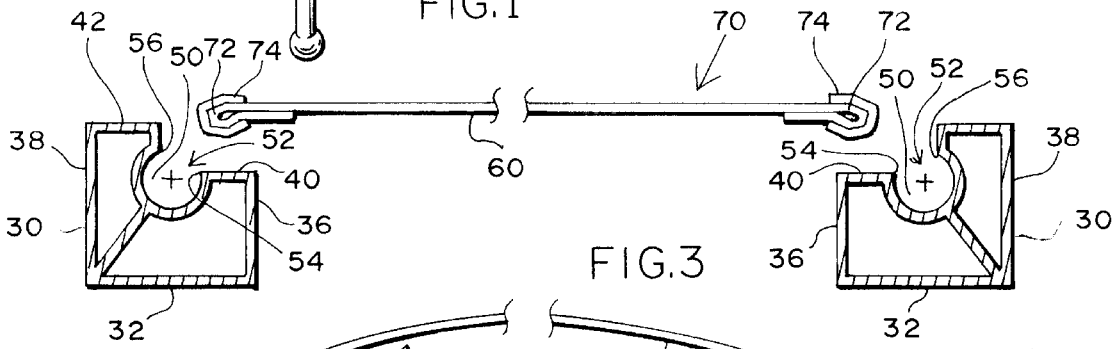
FIG. 3 is a cross section view of opposed anchors of the present invention showing a broken side view of the insert of said invention.
Figure 4:
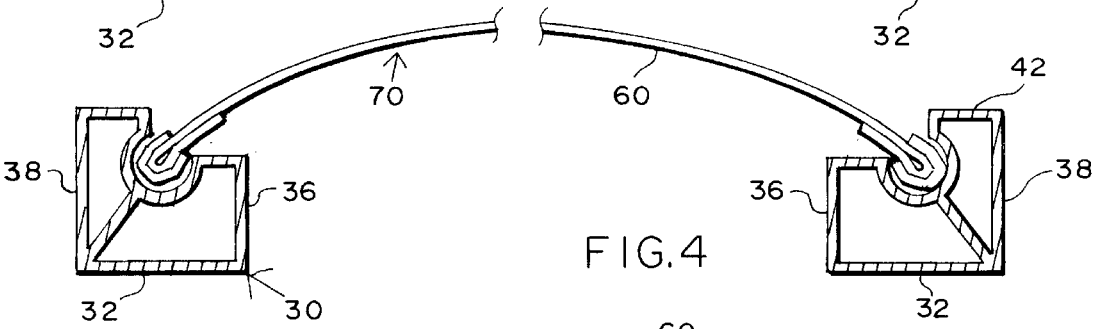
FIG. 4 is a broken, side view showing a heated insert of the present invention being introduced into a cross section view of opposed anchors of the present invention; and, FIG. 5 is a broken side view of the cooled insert of the present invention set into a cross section view of opposed anchors of the present invention.
Figure 5:
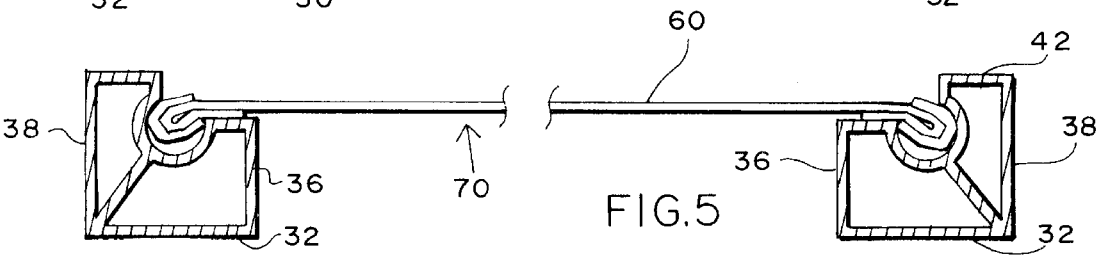

Referring now to FIGS. 3 through 5, strap 60 has opposed ends thereof which terminate in loops 72. The strap may be fashioned of any common material typically associated with the manufacture of furniture. This invention contemplates the use of vinyl as the material for strap 60. Each loop is secured with a clip 74 and retained therein, and, in such form, the insert 70 is created. Clip 74 is sized to engage loosely initially within cavity 50 and may be made of a material, such as a metal or plastic, that has sufficient strength to retain the looped strap 60 when pulled. The preferred material used for the clip 74 is aluminum or another workable metal.

In operation, as seen in FIGS. 4 and 5, on the frame 12 of furniture 10, the anchor 30 is permanently secured thereon to any bar, for example, seat support 18, by means of welding, screwing or other suitable means. The anchor 30 may also be an integral component of the frame 12. A second anchor 30 is secured on to an opposed facing support 20. The cavities 50 of each anchor 30 are positioned to face each other, respectively.

The strap 60 has a length that, when at room temperature, is taught across the seat frame 14 or back frame 16, for example, of frame 12. In order to place the clips 74 of insert 70 into anchors 30, respectively, the insert 70, and thus strap 60, is heated. One method of heating the insert 70 is by placing it in a hot air oven. It is preferred that insert 70 is heated at a temperature of 180–200 degrees F. for five (5) minutes. The pliability of the heated, stretched, strap 60 permits the clips 74 of insert 70 to engage loosely initially within the cavities 50 of the anchors 30. When strap 60 cools, it looses its heated pliability and attempts to shrink to its unheated (room temperature) length. As strap 60 cools and shrinks, it pulls insert 70 along the X axis (for seat frame 14 or Y axis for back frame 16) of anchor 30 and parallel thereto. Each clip 74 of insert 70 then comes into contact with edge 54 along the X axis which then creates an upward movement of clip 74 into edge 56. This upward movement of clip 74 prevents insert 70 from slipping out of the anchor 30. The resultant effect is that strap 60 is prevented from shrinking completely to a room temperature length and is retained within the cavity 50 of anchor 30 forming a bridge across the furniture frame 12. Any desired number of straps 60, whose combined width does not exceed the length of the anchors 30, may be fashioned across the frame 12 to provide a complete bridge thereover sufficient to hold the weight of a user. As a result, variable strap spacing is achieved.

While the disclosed shape of cavity 50 is generally round and that of mating member clip 74 is similarly round, any shape of these mating members can be incorporated within the subject of this invention.

It is intended that the description of the preferred embodiment of this invention is illustrative only. Other embodiments of the invention that are within the scope and concept of this invention are herein included within this invention.

What is claimed is:

1. A strap retainer assembly, comprising, in combination, an anchor having a bottom section, a front section and a back section, and a cavity having a substantially uniform and lengthwise opening, and;

an insert comprising a strap of material having two opposed ends and at least one clip for an end where said end is retained by said clip, the entirety of said clip of said insert being introducible into the lengthwise opening of said cavity and rotatable relative to said cavity whereby said strap is not wrapped around said anchor.

2. In the strap retainer assembly of claim 1, said insert being retainable within said cavity when said insert is pulled in a direction parallel to said bottom section of said anchor.

3. In the strap retainer assembly of claim 1, said insert being retainable within said cavity when said insert is pulled in a direction parallel to said back section of said anchor.

4. Furniture having a strap retainer assembly, said furniture comprising a frame, and said strap retainer assembly comprising, in combination, at least two anchors each having a bottom section, a front section and a back section, and a cavity having a substantially uniform lengthwise opening;

a plurality of inserts each comprising a strap of material having two opposed ends and at least one clip for an end where said end is retained by said clip, the entirety of said clip of each of said inserts being introducible whereby said strap is not wrapped around said frame; and means for securing said anchors to said frame.

5. In the furniture of claim 4, said anchors numbering two.

6. In the furniture of claim 4, said inserts being retainable within said cavities when said inserts are pulled in a direction parallel to said bottom section of said anchors.

7. In the furniture of claim 4, said inserts being retainable within said cavities when said inserts are pulled in a direction parallel to said back section of said anchors.

8. Method for retaining straps onto furniture, said method comprising:

building furniture having a strap retainer assembly, such that said furniture comprises a frame, and said strap retainer assembly comprising, in combination, at least two anchors each having a bottom section, a front section and a back section, and a cavity having a substantially uniform opening;

a plurality of inserts each comprising a strap of material having two opposed ends and at least one clip for an end where said end is retained by said clip, said clip of each of said inserts being rotationally retainable within the opening of said cavity, whereby said strap is not wrapped around said frame;

means for securing said anchors to said frame;

heating said inserts;

engaging said heated inserts with said cavity of said anchors, and;

allowing said inserts to cool and to be retainable at the opening of said cavity of said anchors.

* * * * *